United States Patent [19]

Urion et al.

[11] Patent Number: 4,553,711

[45] Date of Patent: Nov. 19, 1985

[54] MODULAR HOLDER FOR ROLLS

[75] Inventors: Kenard E. Urion, Gloucester County, N.J.; Peter Bressier, Philadelphia County, Pa.

[73] Assignee: Scott Paper Company, Philadelphia, Pa.

[21] Appl. No.: 623,186

[22] Filed: Jun. 21, 1984

[51] Int. Cl.[4] ..... B65H 19/04

[52] U.S. Cl. ..... 242/55.3; 242/129.5

[58] Field of Search ..... 242/55.2, 55.3, 55.53, 242/129.5; 403/171, 176, 292, 295, 296, 230; 52/648–665; 211/164; D6/96, 97; 225/46, 47, 93, 106

[56] References Cited

U.S. PATENT DOCUMENTS

| | | | |
|---|---|---|---|
| 3,079,099 | 2/1963 | Blain | 242/55.2 |
| 3,398,908 | 8/1968 | Thompson | 242/55.2 |
| 3,552,669 | 1/1971 | Earnest | 242/55.3 |
| 3,632,147 | 1/1972 | Finger | 52/665 X |
| 3,750,971 | 8/1973 | Chevas | 242/55.3 |
| 4,129,975 | 12/1978 | Gabriel | 52/648 |

*Primary Examiner*—Leonard D. Christian

*Attorney, Agent, or Firm*—J. H. Yamaoka; J. W. Kane, Jr.

[57] ABSTRACT

The modular roll product holder 10 of this invention comprises two support panels 20,22 each adapted to be secured to a mounting surface 16,18 and a hinged connector 24 adapted to be removably secured to the two support panels, 20,22 and two roll support spindles 26,28 each having one end 44 adapted to be secured to a support panel 20,22. The hinge 38 allows the two support panels 20,22 to be connected together at different planar angles. Each support panel 20,22 can be adapted to be secured to a mounting surface 16,18 by a mounting bracket 12,14 that can be removably secured to the support panel 20,22 and, the support panels 20,22 are adapted to be secured to the brackets 12,14 and to the hinged connector 24 by means of flanges 46 that fit within mating grooves 48.

15 Claims, 6 Drawing Figures

MODULAR HOLDER FOR ROLLS

TECHNICAL FIELD

This invention relates generally to a holder for multiple rolls, and more particularly to a modular roll holder that can be assembled to accommodate a number of different roll orientations and which can be mounted either on a single mounting surface or on two mounting surfaces that form a corner.

BACKGROUND ART

In the typical prior art multiple roll holders, the roll support members or spindles are mounted in a fixed relationship with respect to each other. One example of a prior art multiple roll holder is described in U.S. Pat. No. 3,398,908—Thompson, which discloses a unitary holder having a left horizontal roll support member and a right horizontal roll support member, each able to support a roll of toilet tissue. U.S. Pat. No. 3,552,669—Earnest, discloses a four roll holder in which a pair of unitary plate members include circular flanges for supporting four rolls of toilet tissue.

One disadvantage of the roll holders disclosed by Thompson and by Earnest is that the relative position or orientation of the rolled products in the holder is determined by the construction of the holder itself. It would be desirable to have a multiple roll holder that is modular in construction and which can be assembled together in a number of different ways so that the user can select the relative position or orientation of each roll on the holder. It would also be desirable to provide the user with the flexibility to mount the multiple roll holder either on a single mounting surface or on two mounting surfaces that form a corner.

One approach for providing a multiple roll holder with selectable positioning or orientation of the rolls is to use a multi-faceted connector of the type disclosed in U.S. Pat. Nos. 3,632,147—Finger, and 4,129,975—Gabriel. One disadvantage of using a multi-faceted single connector is that each facet has to be adapted to receive the end of a roll support spindle which complicates the design and manufacture of the connector elements. Another disadvantage of using a multi-faceted single connector is that the facets can not be separated from the connector to build multiple single roll holders.

It is, therefore, one object of this invention to provide a modular holder in which the parts can be assembled into one multiple roll holder or into several single roll holders.

It is another object of this invention to provide a modular holder for two or more rolled products which can be readily assembled to provide a number of different positioning or orientation of the rolls.

And yet another object of this invention is to provide a modular holder for two or more rolled products which can be readily mounted on either a single mounting surface or on two mounting surfaces that form a corner.

DISCLOSURE OF THE INVENTION

The modular roll product holder of this invention comprises at least two support panels each adapted to be secured to a mounting surface, a hinged connector adapted to be removably secured to the two support panels, and roll support members each having one end adapted to be secured to a support panel. Because the connector is hinged, the two support panels can be connected together at different planar angles.

In one aspect of the invention, each support panel is adapted to be secured to a mounting surface by a mounting bracket that can be removably secured to the support panel.

In another aspect of this invention, the support panels are adapted to be secured to the brackets and to the hinged connector by means of flanges that fit within mating grooves. In one embodiment the panels have flanges and the brackets and hinged connector have grooves, and in another embodiment, the brackets and hinged connector can have flanges while the panels have mating grooves.

BRIEF DESCRIPTION OF THE DRAWINGS

While the specification concludes with claims particularly pointing out and distinctly claiming that which is regarded as the present invention, the objects and advantages of this invention can be more readily ascertained from the following description of a preferred embodiment when read in conjunction with the accompanying drawings in which:

BEST MODE FOR CARRYING OUT THE INVENTION

For the sake of convenience, an element depicted in more than one figure will retain the same element number in each figure.

Figure 1:
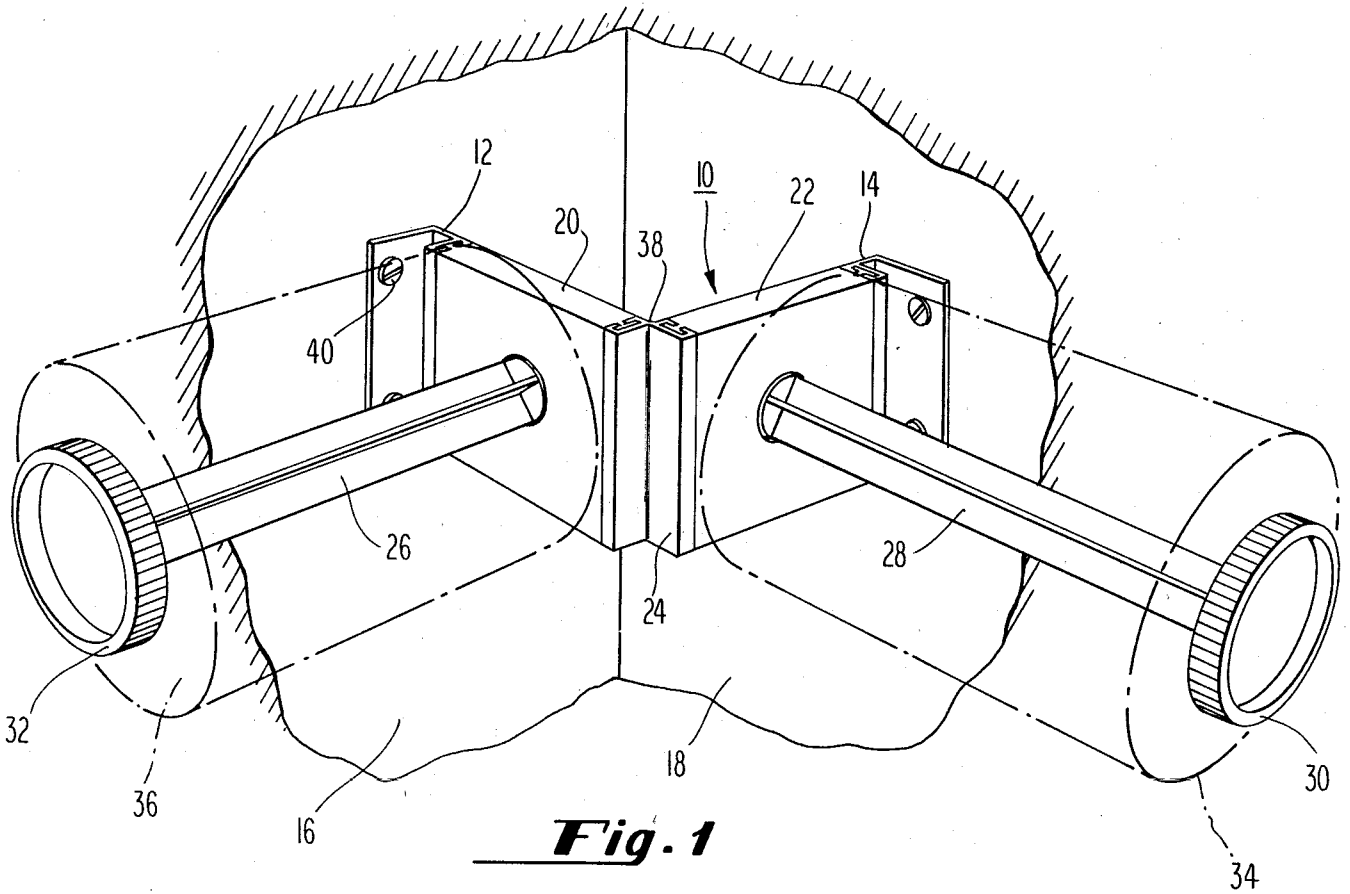
FIG. 1 is an isometric view of a corner mounted, modular holder supporting two horizontal rolls side by side.

Referring now to FIG. 1, there is shown a modular roll holder 10 configured to mount in a corner formed by mounting surfaces 16 and 18. As shown, the holder includes two brackets 12,14 secured to the walls 16,18 by screws 40. Secured to each bracket 12,14 is a support panel 20,22. The two support panels 20,22 are connected together by means of a hinged connector 24. Roll support elements, or spindles 26,28, having one end secured to each support panel 20,22 support rolls 34,36, shown in phantom, which could for example either be toilet tissue rolls or rolls of paper towels. Roll retainer knobs 30,32 secured to the other end of each spindle 26,28 keeps the rolls 34,36 on the spindles 26,28. In one preferred embodiment, the retainer knobs 30,32 are integrally molded as a part of support spindles 26,28.

Figure 2:
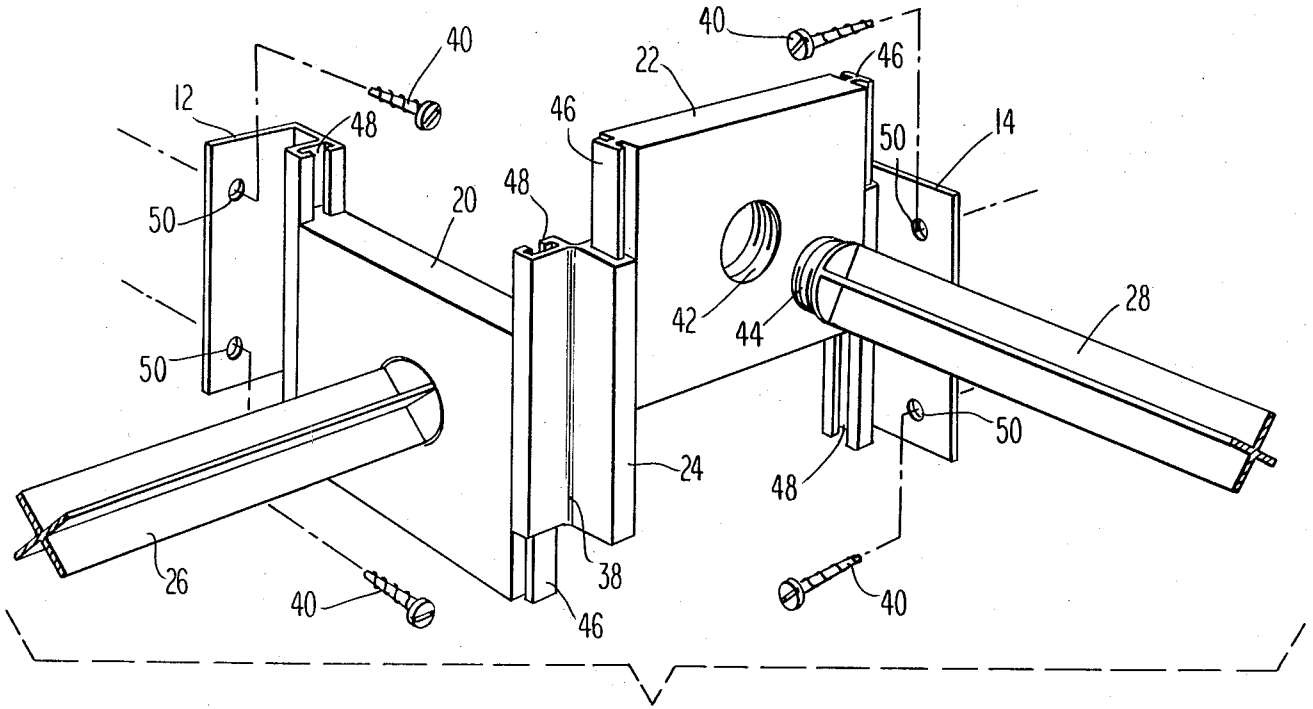
FIG. 2 is an exploded isometric view of a corner mounted modular roll product holder.

Referring now to FIG. 2, each support panel 20,22 is rectangular and has one pair of opposed edges that terminates in a T-shaped flange 46. Each mounting bracket 12,14 has an edge that contains a groove 48 that mates with a flange 46 of support panel 20. In one constructed embodiment, the support panels 20,22 are fabricated out of high impact styrene which is a very rigid material while the brackets 12,14 are fabricated out of extrusion grade styrene which is more flexible than the high impact styrene. The grooves 48 in the brackets 12,14 are dimensioned to fit tightly over flanges 46, but because the brackets 12,14 are more flexible than the flange 46 of support panels 20,22, the grooves 48 can expand slightly to receive the flanges 46 and provide enough of a friction fit to keep the support panels 20,22 assembled within the brackets 12,14. The hinged connector 24 also has two grooves 48 that mate with flanges 46 on each support panel 20,22. In a preferred embodiment, the hinged connector 24 is made out of a flexible plastic material such as polypropylene, polyvinyl chloride, or polyethylene. The mating grooves 48 in the hinged connector 24 are also dimensioned to tightly fit over flanges 46 and because of the flexibility of the hinged connector 24 material, the mating grooves 48 expand to receive the flanges 46 yet provide enough of a friction fit to provide integrity to the assembled holder 10. The connector 24 is hinged at line 38 so that the mating grooves 48 connect support panel 20 at right angles to support panel 22. One preferred method of securing the roll support spindles 26,28 to the support panels 20,22 is to provide a threaded hole 42 in each support panel 20,22 and to thread one end 44 of each support spindle 26,28. The roll support spindles 26,28 can then be readily screwed into the support panels 20,22. Of course, other methods can be used to secure the roll support spindles 26, 28 to the support panels 20, 22 such as a bayonet mount or a snap mount.

Figure 3:
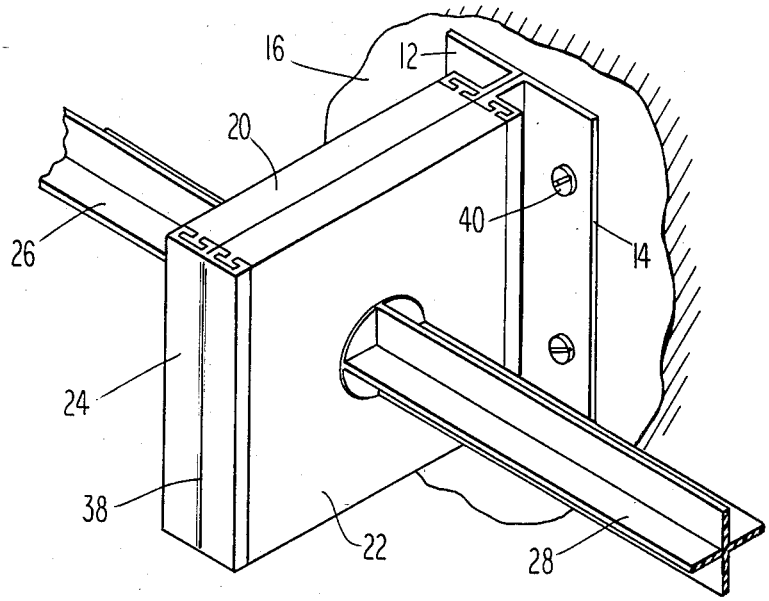
FIG. 3 is an isometric view of a modular holder mounted on a single wall and supporting two horizontal rolls end to end.

FIG. 3 shows how the same elements that make up the assembled holder 10 of FIG. 1 can be arranged to provide a holder 10 that can be mounted on a single mounting surface 16 and which will support two rolls, not shown, end to end with their axes horizontal. Because the connector 24 is hinged at 38, the same connector 24 can be used to provide the corner mounted holder 10 shown in FIG. 1 or the single wall mounted holder 10 of FIG. 3.

Figure 4:
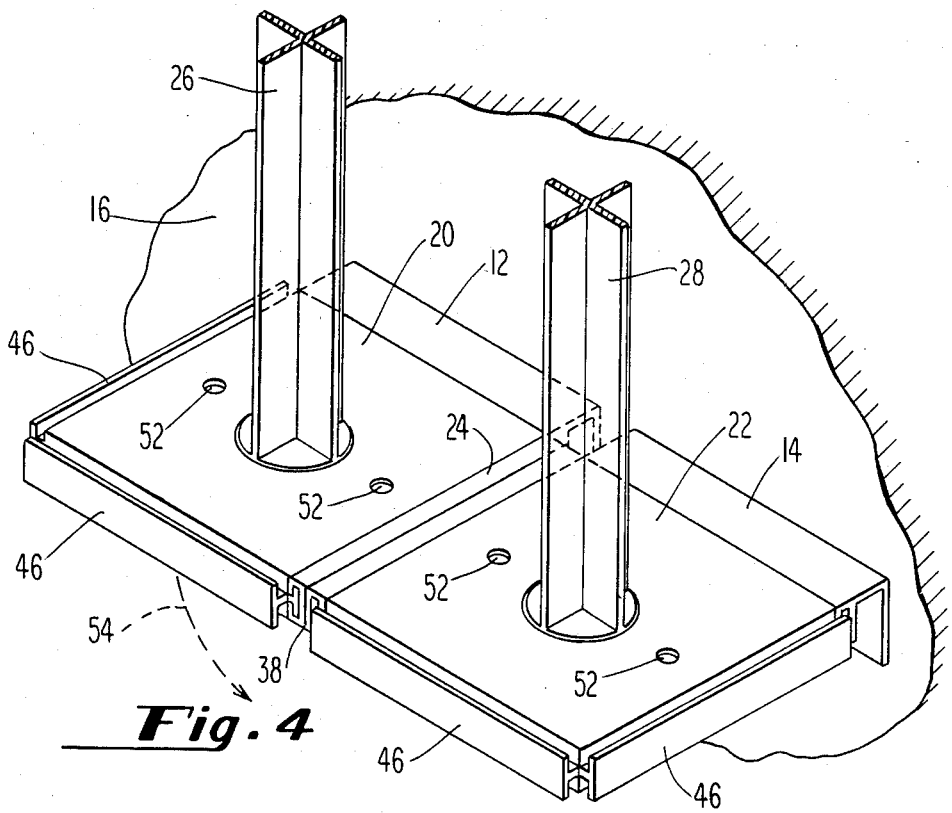
FIG. 4 is an isometric view of a modular holder mounted on a single wall supporting two vertical rolls side by side.

FIG. 4 shows a modular holder 10 which is assembled on a single mounting surface 16 and which supports two rolls, not shown, side by side with their axes vertical. The brackets 12,14 and the hinged connector 24 is exactly the same as those depicted in FIGS. 1, 2 and 3. The support panels 20,22 of FIG. 4 differ from the support panels 20,22 depicted in FIGS. 1–3 in that all four edges of each support panel 20,22 terminate in a flange (46). Because the connector 24 is hinged at 38, it can be assembled so that the two mating grooves 46 are oriented back to back as shown in FIG. 4.

It is also possible to assemble a modular holder 10 that can be mounted on a single mounting surface 16 and in which the axis of one supported roll is oriented vertically and the axis of the second roll is oriented horizontally. Such an assembly can be obtained from FIG. 4 by rotating support panel 20 and its associated roll support spindle 26 and bracket 12 ninety degrees counter-clockwise about the hinge 38 as indicated by the the dashed arrow 54.

It is also evident from FIG. 4 that the modular holder 10 can be expanded to support more rolls by adding additional modules which could support rolls with their axes oriented either vertically or horizontally.

Each support panel 20,22 depicted in FIG. 4 also has two holes 52 which can be used to mount a support panel 20,22 directly to a wall surface if the user so desired.

Because the connector 24 is hinged at line 38, a modular roll holder 10 can be assembled so that two support panels (a) form a ninety degree planar angle as shown in FIG. 1, (b) form two parallel planes as shown in FIG. 3, (c) are coplanar as shown in FIG. 4, or (d) form a planar angle in a corner formed by two mounting surfaces that have an included angle that is greater than ninety degrees.

Although FIGS. 1–4 depicted a modular holder 10 that supported two rolls, it is clear that a user could use the brackets 12,14, support panels 20,22 and roll support spindles 26,28 to assemble two separate single roll holders.

Figure 5:
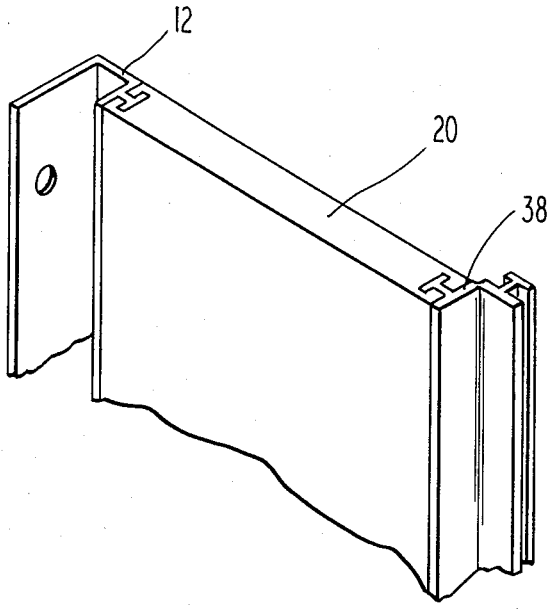
FIG. 5 is a partial isometric view of alternate panel, bracket and hinge embodiments.
Figure 6A:
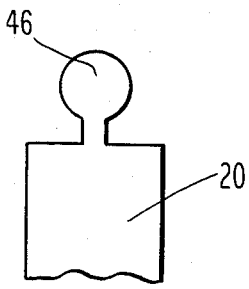
FIG. 6 is a partial plan view of a panel having equivalent flange-shaped elements.
Figure 6B:
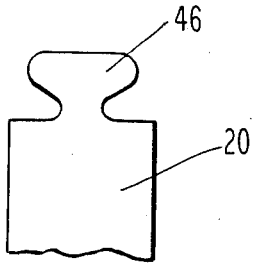

While the present invention has been described with reference to a specific embodiment thereof, it will be obvious to those skilled in the art that various changes and modifications may be made without departing from the invention in its broader aspects. For example, although the modular holder 10 depicted in FIGS. 1–4 depict brackets 12,14 separate and distinct from each support panel 20,22, it will be apparent to one skilled in the art that the benefits of this invention would also be obtained if the brackets 12,14 were an integral part of support panels 20,22. Also, although the embodiments depicted in FIGS. 1–4 show each support panel 20,22 as having edges that terminate in flanges 46 which fit into mating grooves 48 in brackets 12,14 and hinged connector 24, as illustrated in FIG. 5 the benefits of this invention are also achieved if the edges of brackets 12,14 as well as hinged connector 24 have flanges and the edges of support panels 20,22 terminate in grooves that mate with the flanges. Also, although the described embodiment used a flange having a T-shape, it will be understood by those skilled in the art that the flange can have other shapes such as a key-hole shape or a flared shape as shown in FIGS. *6a* and *6b*.

What is claimed is:

1. A modular roll product holder comprising:

(a) first and second panels, each panel having an edge that includes a flange-shaped element;

(b) a hinged connector having two panel receiving elements separated by a hinge, each panel receiving element having a groove that mates with the flange-shaped element, whereby each panel can be removably secured to the connector, the hinge allowing the first and second panels to be connected together at different angles; and (c) first and second roll support means having one end secured respectively to the first and second panels.

2. The modular roll product holder of claim 1 further comprising first and second brackets secured respectively to the first and second panels for mounting the panels to a mounting surface.

3. The modular roll product holder of claim 2 wherein the first and second panels each have a second edge that includes a flange-shaped element and wherein each bracket has a panel receiving element including a groove that mates with the flange-shaped element whereby each bracket cap be removably secured to the panel.

4. The modular roll product holder of claim 3 wherein each bracket has a flange-shaped element and wherein the first and second panels each have one edge that includes a groove that mates with the flange-shaped element.

5. The modular roll product holder of claim 1 wherein the two elements of the connector, separated by the hinge, include the flange-shaped elements and said one edge of each panel includes the mating groove.

6. The modular roll product holder of claim 5 further comprising first and second brackets secured respectively to the first and second panels for mounting the panels to a mounting surface.

7. The modular roll product holder of claim 6 wherein each bracket includes a flange-shaped element and wherein the first and second panels each have a second edge that includes a groove that mates with the flange-shaped element whereby each bracket can be removably secured to the panel.

8. The modular roll product holder of claim 7 wherein each support panel is rectangular and each edge of the panel includes a mating groove.

9. The modular roll product holder of claim 1 further comprising roll retainer knobs secured to the other end of the roll support means.

10. The modular roll product holder of claim 1 wherein the one end of each roll support means has threads and each panel is threaded whereby each roll support means can be screwed into a respective panel.

11. The modular product holder of claim 1 wherein each panel includes mounting holes to facilitate mounting the panels directly to a mounting surface.

12. The modular roll product holder of claim 3 wherein each support panel is rectangular and each edge includes a flange-shaped element.

13. The modular roll product holder of claim 1 wherein the flange-shaped elements are T-shaped.

14. The modular roll product holder of claim 1 wherein the flange-shaped elements are key-hole shaped.

15. The modular roll product holder of claim 1 wherein the flange-shaped elements have a flared shape.

* * * * *